United States Patent [19]

Tseng

[11] Patent Number: 5,012,397

[45] Date of Patent: Apr. 30, 1991

[54] SOCKET AND CHANGEABLE BULB HOUSING SNAP FASTENER FOR CHRISTMAS LIGHT STRINGS

[76] Inventor: Jeou N. Tseng, No. 539, Sec. 4, Chung Hua Rd., Hsin Chu City, Taiwan

[21] Appl. No.: 567,800

[22] Filed: Aug. 15, 1990

[51] Int. Cl.[5] ..... F21V 17/06

[52] U.S. Cl. ..... 362/237; 362/457; 362/806

[58] Field of Search ..... 362/122, 123, 235, 236, 362/237, 252, 433, 443, 457, 458, 806

[56] References Cited

U.S. PATENT DOCUMENTS

| | | | |
|---|---|---|---|
| 2,225,183 | 12/1940 | Schwoor | 362/457 |
| 3,263,353 | 8/1966 | Quinn | 362/806 |
| 4,234,915 | 11/1980 | Malinowski et al. | 362/252 |
| 4,667,276 | 5/1987 | Cheng | 362/252 |
| 4,679,126 | 7/1987 | Van Sickler | 362/806 |
| 4,827,382 | 5/1989 | Feuks | 362/806 |
| 4,833,580 | 5/1989 | Allen | 362/806 |

*Primary Examiner*—Ira S. Lazarus

*Assistant Examiner*—Richard R. Cole

*Attorney, Agent, or Firm*—Wood, Herron & Evans

[57] ABSTRACT

A socket and changeable bulb housing snap fastener for Christmas light strings includes a bulb housing with at least one tongue and a corresponding number of T-shaped male members. An annular outer flange is formed on the socket. The T-shaped male member has a snapping head and is formed on an outer periphery of an annular hollow engaging portion of the bulb housing. The tongue is made of insulating material and extends radially and outwardly from an outer periphery of the outer flange. A rectangular slot, having a width slightly less than a maximum width of the snapping head of the T-shaped male member, is formed on the tongue adjcent to a free end of the tongue. A V-shaped groove is formed on an upper side of the tongue at an end opposite to the free end and extends transversely to a length of the tongue. The slot is engageable with the T-shaped male member by bending the tongue upwardly about the V-shaped groove and pushing the tongue against the T-shaped male member, such that the snapping head is forced through the slot.

2 Claims, 4 Drawing Sheets

SOCKET AND CHANGEABLE BULB HOUSING SNAP FASTENER FOR CHRISTMAS LIGHT STRINGS

BACKGROUND OF THE INVENTION

The present invention relates to a snap fastener and in particular to a socket and changeable bulb housing snap fastener for Christmas light strings.

A conventional bulb and socket device in a light bulb string for a Christmas tree generally comprises a socket formed with a hole, a bulb consisting of a lighting element, and an insert including two leads which are mounted on either side of the insert and electrically connected to the lighting element.

Applicant's U.S. patent application Ser. No. 07/446,936 discloses a socket and bulb snap fastener for Christmas light strings comprising at least one T-shaped male member having a snapping head and a corresponding number of tongues, designed to avoid problems commonly encountered during use of known Christmas light strings.

Applicant's U.S. patent application Ser. No. 07/494,309 discloses another type of socket and bulb snap fastener for Christmas light strings comprising at least one T-shaped tongue with a shoulder and a corresponding number of receiving means, including a compartment for receiving the tongue and a path through which the tongue is passable.

Nevertheless, like conventional Christmas Light strings, both of the two above-mentioned patent applications do not offer changeable bulb housing. The present invention provides a design of a socket and changeable bulb housing snap fastener for Christmas light strings.

SUMMARY OF THE INVENTION

According to one aspect of the present invention, a socket and changeable bulb housing snap fastener for Christmas light strings comprises a socket and a bulb. The bulb comprises a lighting element and an insert having two leads mounted thereon which are electrically connected to the lighting element. A hole is centrally formed on the socket for receiving the insert. The insert and the socket of the present invention are the same as prior art.

The features of the socket and bulb snap fastener according to the present invention constitute an annular outer flange formed on the socket. At least one T-shaped male member with a snapping head extends radially and outwardly from a periphery of the outer flange. This embodiment further comprises a bulb housing having a hollow annular engaging portion for engaging with the socket. An annular inner flange is formed on an uppermost portion of an inner periphery of the engaging portion. The engaging portion receives an upper portion of the socket and rests on the annular outer flange, while the annular inner flange rests on an upper surface of the insert.

A corresponding number of tongues, made of an insulating material, is formed relative to each T-shaped male member on an outer periphery of the annular engaging portion of the bulb housing. A substantially rectangular slot, having a width slightly less than a maximum width of the snapping head of the T-shaped male member, is formed on each tongue adjacent to a free end of each tongue. A V-shaped groove is formed on an underside of each tongue at an end opposite to the free end and extends transversely to a length of each tongue. Each slot is engageable with each corresponding T-shaped male member by bending the tongue downwardly about the V-shaped groove and pushing each tongue against each corresponding T-shaped male member, such that each respective snapping head is forced through each corresponding slot.

According to another aspect of the present invention, the socket and changeable bulb housing snap fastener is characterized in that an annular outer flange is formed on the socket. At least one tongue of insulating material extends radially and outwardly from a periphery of the outer flange. A substantially rectangular slot is formed on each tongue adjacent to a free end of each tongue. A V-shaped groove is formed on an upper side of each tongue at an end opposite to the free end and extends transversely to a length of each tongue. The present invention further comprises a changeable bulb housing having a hollow annular engaging portion for engaging with the socket. An annular inner flange is formed on an uppermost portion of an inner periphery of the engaging portion. The engaging portion receives an upper portion of the socket and rests on the annular outer flange, while the annular inner flange rests on an upper surface of the insert.

A corresponding number of T-shaped male members having a snapping head is formed relative to each tongue on an outer periphery of the annular engaging portion of the bulb housing. Each slot has a width slightly less than a maximum width of the snapping head of the T-shaped male member. Each slot is engageable with each corresponding T-shaped male member by bending each tongue upwardly about the V-shaped groove and pushing each tongue against each corresponding T-shaped male member, such that each respective snapping head is forced through each corresponding slot.

It is therefore a primary object of the present invention to provide a snap fastener for a light bulb string in which the bulb housing is changeable.

This and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
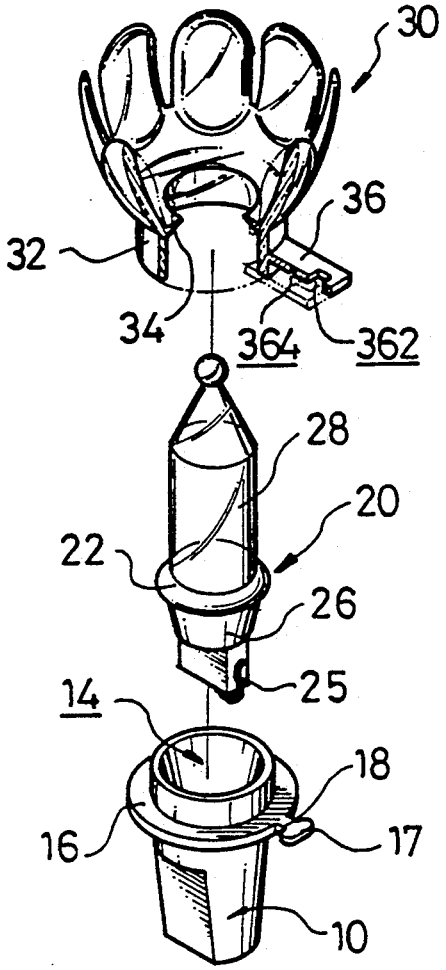
FIG. 1 is an exploded perspective view of a socket and changeable bulb housing snap fastener for Christmas light strings in accordance with the present invention.
Figure 2:
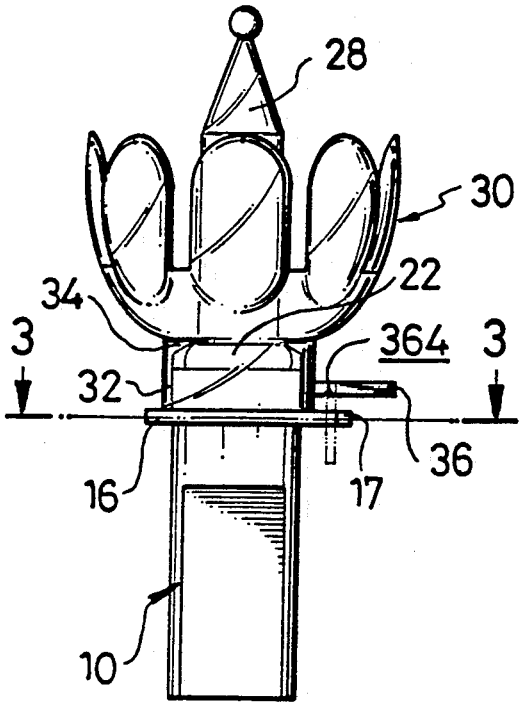
FIG. 2 is a side view of the socket and changeable bulb housing snap fastener of FIG. 1, in accordance with the present invention, showing the securing effect of the snap fastener.
Figure 3:
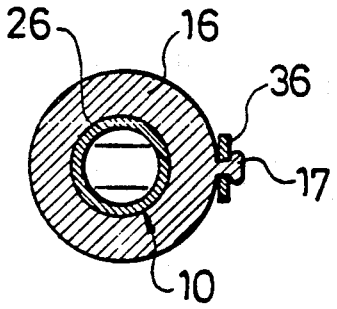
FIG. 3 is a cross-sectional view taken along line 3—3 in FIG. 2 as seen from above showing the secured position.

Referring to FIGS. 1, 2 and 3, a socket and changeable bulb housing snap fastener for Christmas light strings comprises a socket 10 and a bulb 20. The bulb 20 comprises a lighting element 28 and an insert 26 having two leads 25 mounted thereon (only one lead is shown) which are electrically connected to the lighting element 28. A hole 14 is centrally formed on the socket 10 for receiving the insert 26. The socket 10 and the bulb 20 are the same as prior art.

The snap fastener according to the present invention is characterized in that an annular outer flange 16 is formed on the socket 10. At least one T-shaped male member 18 with a snapping head 17 extends radially and outwardly from a periphery of the outer flange 16. This embodiment further comprises a bulb housing 30 having a hollow annular engaging portion 32 for engaging with the socket 10. An annular inner flange 34 is formed on an uppermost portion of an inner periphery of the engaging portion 32. The engaging portion 32 receives an upper portion of the socket 10 and rests on the annular outer flange 16, while the annular inner flange 34 rests on an upper surface 22 of the insert 26.

A corresponding number of tongues 36, made of an insulating material, is formed relative to each T-shaped male member 18 on an outer periphery of the annular engaging portion 32 of the bulb housing 30. A substantially rectangular slot 362, having a width slightly less than a maximum width of the snapping head 17 of the T-shaped male member 18, is formed on each tongue 36 adjacent to a free end of each tongue 36. A V-shaped groove 364 is formed on an underside of each tongue 36 at an end opposite to the free end and extends transversely to a length of each tongue 36. Each slot 362 is engageable with each corresponding T-shaped male member 18 by bending the tongue 36 downwardly about the V-shaped groove 364 and pushing each tongue 36 against each corresponding T-shaped male member 18, such that each respective snapping head 17 is forced through each corresponding slot 362.

Figure 4:
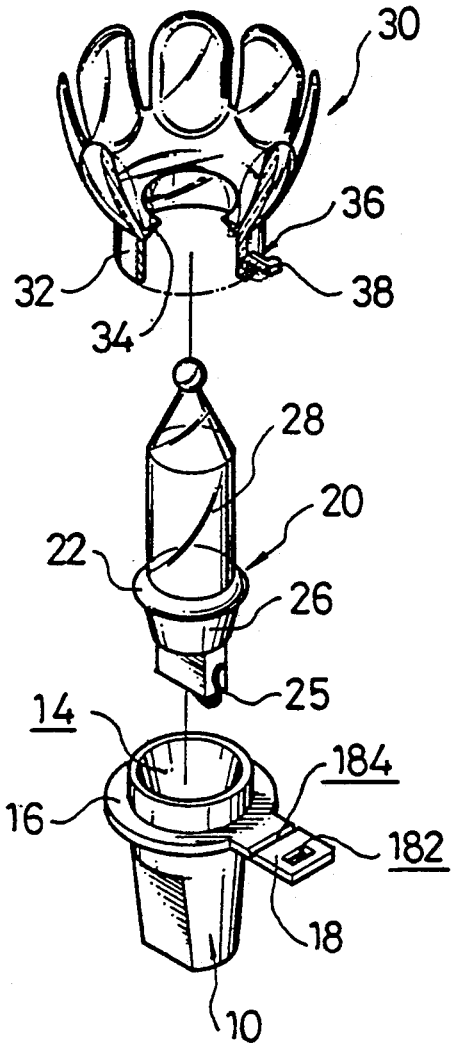
FIG. 4 is an exploded perspective view showing another preferred embodiment of the present invention, wherein the position of the tongue and the T-shaped male member in FIG. 1 are interchanged.

Referring to FIG. 4 according to another aspect of the present invention, the socket and changeable bulb housing snap fastener is characterized in that an annular outer flange 16 is formed on the socket 10. AT least one tongue 18 of insulating material extends radially and outwardly from a periphery of the outer flange 16. A substantially rectangular slot 182 is formed on each tongue 18 adjacent to a free end of each tongue 18. A V-shaped groove 184 is formed on an upper side of each tongue 18 at an end opposite to the free end and extends transversely to a length of each tongue 18. The present invention further comprises a changeable bulb housing 30 having a hollow annular engaging portion 32 for engaging with the socket 10. An annular inner flange 34 is formed on an uppermost portion of an inner periphery of the engaging portion 32. The engaging portion 32 receives an upper portion of the socket 10 and rests on the annular outer flange 16, while the annular inner flange 32 rests on an upper surface 22 of the insert 20.

A corresponding number of T-shaped male members 36 having a snapping head 38 is formed relative to each tongue on an outer periphery of the annular engaging portion 32 of the bulb housing 30. Each above-mentioned slot 182 has a width slightly less than a maximum width of the snapping head 38 of the T-shaped male member 36. Each slot 182 is engageable with each corresponding T-shaped male member 36, by bending each tongue 16 upwardly about V-shaped groove 184 and pushing each tongue 18 against each corresponding T-shaped male member 36 such that each respective snapping head 38 is forced through each corresponding slot 182.

Figure 5:
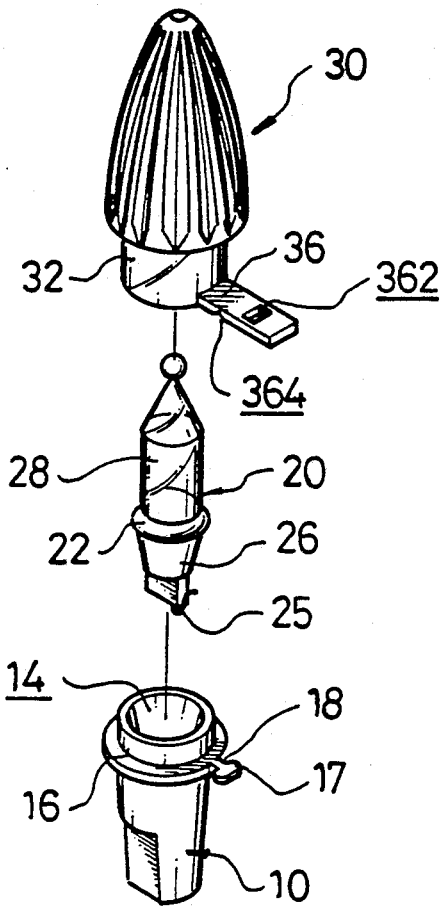
FIG. 5 is an exploded perspective view of another preferred embodiment of the present invention, wherein another type of bulb housing is utilized.

FIG. 5 shows another type of a socket and changeable bulb housing snap fastener according to the present invention, in which another type of bulb housing 30 is utilized. The other elements, such as the socket 10, the bulb 20, the T-shaped male member 18 and the tongue 36, as well as the snapping function, are the same as the above-illustrated embodiments.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A socket and changeable bulb housing snap fastener for Christmas light strings, comprising a socket and a bulb, said bulb comprising a lighting element and an insert having two leads mounted thereon which are electrically connected to said lighting element, a hole being centrally formed on said socket for receiving said insert, the improvement comprising:

an annular outer flange being formed on said socket;

at least one tongue of insulating material extending radially and outwardly from a periphery of said outer flange, a substantially rectangular slot being formed on each said tongue adjacent to a free end of each said tongue, a V-shaped groove being formed on an upper side of each said tongue at an end opposite to said free end and extending transversely to a length of each said tongue;

a bulb housing having a hollow annular engaging portion for engaging with said socket, an annular inner flange being formed on an uppermost portion of an inner periphery of said engaging portion, said engaging portion receiving an upper portion of said socket and resting on said annular outer flange, while said annular inner flange rest on an upper surface of said insert;

a corresponding number of T-shaped male members having a snapping head being formed relative to each said tongue on an outer periphery of said annular engaging portion of said bulb housing, each said slot having a width slightly less than a maximum width of said snapping head of said T-shaped male member, each said slot being engageable with each corresponding said T-shaped male member by bending each said tongue upwardly about said V-shaped groove and pushing each said tongue against each corresponding said T-shaped male member, such that each respective said snapping head is forced through each corresponding said slot.

2. A socket and changeable bulb housing snap fastener for Christmas light strings, comprising a socket and a bulb, said bulb comprising a lighting element and an insert having two leads mounted thereon which are electrically connected to said lighting element, a hole being centrally formed on said socket for receiving said insert, the improvements comprising:

An annular outer flange being formed on said socket;

at least one T-shaped male member with a snapping head extending radially and outwardly from a periphery of said outer flange;

a bulb housing having a hollow annular engaging portion for engaging with said socket, an annular inner flange being formed on an uppermost portion of an inner periphery of said engaging portion, said engaging portion receiving an upper portion of said socket and resting on said annular outer flange, while said annular inner flange rests on an upper surface of said insert;

a corresponding number of tongues of insulating material being formed relative to each said T-shaped male member on an outer periphery of said annular engaging portion of said bulb housing, a substantially rectangular slot, having a width slightly less than a maximum width of said snapping head of said T-shaped male member, being formed on each said tongue adjacent to a free end of each said tongue, a V-shaped groove being formed on an underside of each said tongue at an end opposite to said free end and extending transversely to a length of each said tongue, each said slot being engageable with each corresponding said T-shaped male member by bending said tongue downwardly about said V-shaped groove and pushing each said tongue against each corresponding said T-shaped male member, such that each respective said snapping head is forced through each corresponding said slot.

* * * * *